United States Patent [19]

Nagatsuma et al.

[11] 4,241,596

[45] Dec. 30, 1980

[54] APPARATUS FOR ROLL-FORMING SEAMLESS ANNULAR PRODUCTS

[75] Inventors: Nobuyoshi Nagatsuma, Kawagoe; Shigeo Kaiho, Omiya; Takashi Nagamine, Saitama; Sousuke Sese, Sayama; Kunio Kishino, Ashikaga, all of Japan

[73] Assignee: Honda Giken Kogyo Kabushiki Kaisha, Tokyo, Japan

[21] Appl. No.: 957,111

[22] Filed: Nov. 2, 1978

[30] Foreign Application Priority Data

| | | | |
|---|---|---|---|
| Nov. 4, 1977 | [JP] | Japan | 52/132207 |
| Nov. 10, 1977 | [JP] | Japan | 52/135048 |
| Nov. 10, 1977 | [JP] | Japan | 52/135050 |
| Nov. 17, 1977 | [JP] | Japan | 52/138105 |

[51] Int. Cl.[3] ..... B21B 5/00

[52] U.S. Cl. ..... 72/91

[58] Field of Search ..... 72/91, 93, 124, 115, 72/105; 29/159.1

[56] References Cited

U.S. PATENT DOCUMENTS

| | | | |
|---|---|---|---|
| 3,160,036 | 12/1964 | Ernestus | 72/91 X |
| 3,196,651 | 7/1965 | Karrberg et al. | 72/91 X |
| 3,388,576 | 6/1968 | Ernestus | 72/91 X |
| 3,855,833 | 12/1974 | Connell | 72/91 |

FOREIGN PATENT DOCUMENTS

| | | | |
|---|---|---|---|
| 40-16665 | 8/1965 | Japan | 72/91 |
| 1395726 | 5/1975 | United Kingdom | 72/91 |

*Primary Examiner*—Milton S. Mehr

*Attorney, Agent, or Firm*—Irving M. Weiner; Pamela S. Burt; John L. Shortley

[57] ABSTRACT

An apparatus for roll-forming a blank ring into an annular product such as a seamless wheel rim. The apparatus includes an annular die rotatably supported in a die head, and a pressure roll rotatably supported in a roll head and movable toward and away from the annular die. The apparatus further includes a cylinder unit for moving the pressure roll radially of the annular die when the pressure roll is in the annular die, whereby the blank ring can be interposed between the pressure roll and the annular die. As the die is rotated, the blank ring is roll-formed between the roll and the die into an annular ring, which then is confined in the annular die and can be taken out when the die is disassembled into a plurality of segments. The product thus formed has a high degree of circularity and precision, and is free from distortions.

13 Claims, 18 Drawing Figures

APPARATUS FOR ROLL-FORMING SEAMLESS ANNULAR PRODUCTS

BACKGROUND OF THE INVENTION

1. Field of the Invention

The present invention relates to an apparatus for roll-forming seamless annular products such as wheel rims of an aluminum alloy.

2. Description of the Prior Art

Known methods and apparatus for forming seamless rims for use on bicycles and motorcycles have been described, for example, in Japanese Laid-Open Pat. Nos. 43868/1974 and 42065/1976. Such apparatus generally comprise a pair of opposed rolls. A blank ring is sandwiched between the rolls as they are moved toward each other, to thereby enlarge the diameter of the blank ring. The ring is roll-formed into a rim, and there is provided a plurality of guide rolls for limiting expansion of the diameter of the blank ring.

The prior art apparatus are disadvantageous in that since plastic deformation of the blank ring is much greater in the radial direction than in other directions, the diameter of the blank ring as it is being processed tends to exceed a predetermined dimension before the blank ring is shaped into required cross-sectional contours. The guide rolls are effective to prevent such excessive expansions in diameter, however, they fail to give finished rims a high degree of circularity and dimensional precision because the guide rolls are angularly spaced from each other. With such guide rolls, there have sometimes been produced distorted rims. Various attempts have been proposed to eliminate such difficulty. One such effort has been to provide additional guide rolls. However, this has made the apparatus more complex in structure. Other attempts have involved additional devices or processing steps for correcting the finished rims, thus raising costs. Moreover, the rims thus formed are likely to have reduced strength resulting from the additional correction steps to which the rims have been subjected.

To solve the above-described problems with the conventional methods and apparatus, there has been proposed a roll-forming method comprising the steps of placing a blank ring between a rotatable annular die and a rotatable pressure roll disposed within and movable radially relative to the annular die, rotating the die or the roll so as to cause the other to revolve around the blank ring interposed therebetween, and moving the roll radially toward the die, thereby forming the blank ring into a predetermined cross-sectional shape as the ring is confined within the die. Such method is described in copending U.S. patent application Ser. No. 955,992 filed by the present applicant on Oct. 30, 1978 and entitled "Method of Manufacturing Seamless Wheel Rims."

According to such method, the blank ring is roll-formed by the annular die as the ring is confined within the die, with the results that an annular product is formed with precision as to outer diameter, cross-sectional shape, and circularity, and is free from distortions. The seamless annular product thus produced is required to be subjected only to a minimum number of finishing processes such as a process of removing burrs, with no correction process being required. The method is thus highly advantageous in that it can produce seamless annular products or rims easily, speedily, at less cost, and at a high rate of production.

It can be readily understood that an apparatus for carrying out such method should be able to roll-form annular products easily and reliably, be simple in structure and operation, and be as small in size as possible. Particularly, the annular die of an apparatus for forming annular products such as motorcycle wheel rims is of necessity great in size. Such an apparatus therefore has a number of attendant problems with regard to structure and arrangements for rotatably supporting the annular die and the pressure roll, and cylinder units.

There are a variety of requirements to be met in the construction of the above-mentioned apparatus. More specifically, the die for forming large-diameter products such as motorcycle wheel rims as well as mechanisms ancillary to the die become necessarily large in size, and hence it is difficult to move the die back and forth and up and down without excessive effort. Thus, instead of displacing the die, the pressure roll should be rotated, and moved to and fro, and up and down, and be utilized to load blank rings into position. The force with which the roll presses the blank ring against the annular die is considerably large since the blank ring is required to be subjected to cold rolling. The roll, which is rotatable and movable back and forth, is carried by a support which is itself movable back and forth. Mechanisms for the roll, including the roll support, are necessarily large in weight, and the overall weight of the mechanism and the force applied to the roll must be borne together. This results in a large cylinder unit for the roll, which then requires that arrangements supporting and mounting the cylinder unit be large in size and sufficiently rigid.

To enable removal of a formed product from the die, the annular die should be constructed of separable segments that can be assembled together and spread and separated from each other by a suitable mechanism. One such mechanism includes a cylinder unit which is axially actuated to clamp and release the die segments. With the cylinder unit axially arranged relative to the annular die, however, the die becomes exceedingly long, resulting in an increase in the overall size of the apparatus.

Further, operation of the mechanisms for the die is stopped each time a formed annular product is to be removed from the spread die segments, and is started again for a next cycle of roll-forming operation. Such a procedure involves a great loss of energy because the die is large in size and weight, with the result that the apparatus will operate at a reduced degree of efficiency and at a low rate of production.

In view of the problems attendant the prior art methods and apparatus, and further in view of the practical requirements to be satisfied in an apparatus for carrying out the method discussed above, the present invention provides an apparatus which eliminates the deficiencies conventionally experienced and meets the requirements set forth above.

SUMMARY OF THE INVENTION

The present invention provides an apparatus for roll-forming a blank ring into an annular product including an annular die rotatably supported in a die head, a pressure roll rotatably supported in a roll head and movable toward and away from the annular die, and means for moving the pressure roll radially of the annular die when the pressure roll is positioned in the annular die.

The blank ring can thus be interposed between the pressure roll and the annular die.

A feature of the invention is to provide an annular die which is rotatable by an electric motor when the blank ring is sandwiched between the annular die and the pressure roll. The annular die is constructed of a plurality of die segments which, during rotation thereof, can be put together for roll-forming an annular product therein and can be spread radially apart from each other for releasing the finished annular product. The pressure roll is coaxially mounted on a roll spindle rotatably mounted in a casing supported on the roll head that is movable toward and away from the die head. The roll head includes guide means along which the roll spindle casing is movable for radially displacing the pressure roll. The die head contains a hollow die spindle rotatably mounted therein and supporting therein the annular die, there being a mechanism for clamping and releasing the die segments. The mechanism is actuated by a cylinder unit having a piston rod mounted on the die head and a cylinder movable so as to actuate the mechanism.

It is an object of the present invention to provide an apparatus for roll-forming seamless annular products with a high degree of circularity and dimensional precision.

Another object of the present invention is to provide an apparatus for roll-forming seamless annular products free from any distortion, at an increased rate of production and at less cost.

A further feature of the invention is to provide a roll-forming apparatus in which a casing supporting a roll spindle is supported on a movable roll head so as to be shiftable radially of a roll. A cylinder unit is engageable with the spindle casing only when a blank ring is to be formed into an annular product between a die and the roll. Accordingly, it is not necessary to unite the cylinder unit with the roll head, and the overall structure becomes simple. Since the cylinder unit is subjected to a load only during the roll-forming operation, the cylinder unit can be small in size for a reliable roll-forming operation, and thus the overall structure of the apparatus can be minimized in size.

Yet another feature of the invention is to provide a roll-forming apparatus in which an annular die comprises a plurality of segmental pieces mounted in a cylindrical die spindle, there being a die clamping and releasing mechanism located within the spindle. A cylinder unit for actuating the die clamping and releasing mechanism is supported on a die head in which the die spindle is mounted. Thus, the space in the die head can be effectively utilized for making the apparatus relatively small.

Another feature of the invention is to provide a roll-forming apparatus in which a cylindrical housing is supported in and is rotatable with a cylindrical die spindle which supports die segments and a mechanism for assembling and spreading the die segments. The mechanism is actuated by a cylinder unit fixed to a die head so as to assemble the die segments into an annular die. Therefore, assembling and spreading operation of the die segments can be performed while the die segments are being rotated, and a blank ring can be loaded into the die and a formed product can be taken out of the die during continued rotation thereof, with the result that the apparatus will operate efficiently and effectively.

Many other objects and advantages of the present invention will become apparent to those skilled in the art from the following description when read in conjunction with the accompanying drawings which illustrate an exemplary preferred structural embodiment.

DETAILED DESCRIPTION

Figure 1:
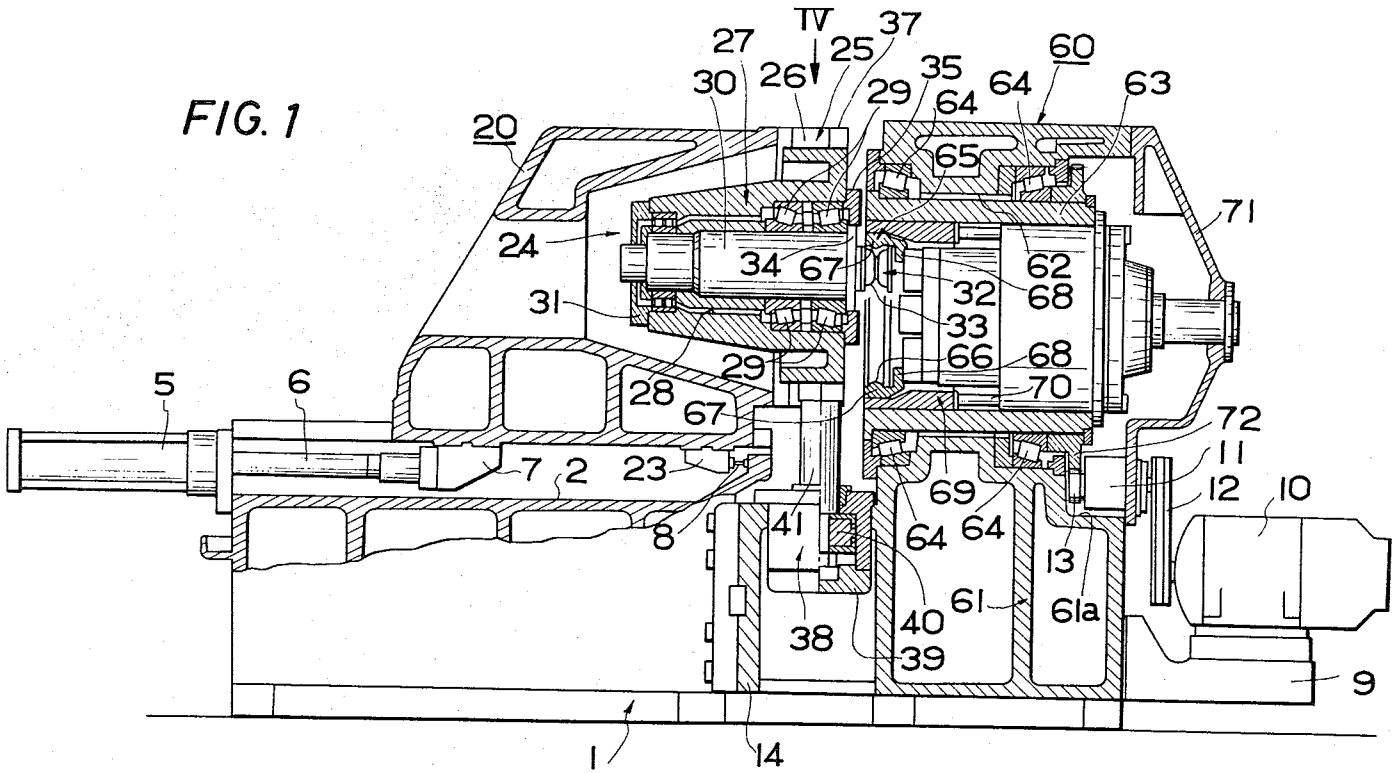
FIG. 1 is a side elevational view partially in cross section of an apparatus constructed in accordance with the present invention.

As shown in FIG. 1, a roll-forming apparatus constructed in accordance with the present invention generally comprises an elongated base 1, a roll head 20, and a die head 60, the heads 20 and 60 being mounted on and arranged longitudinally of the base 1 in confronting relation to each other. The roll head 20 is disposed on a bed 2 fixed to base 1 and is provided with a pair of grooves 21, 21 (FIG. 2) slidably respectively fitted over a pair of guide rails 3, 3, on bed 2, which guide rails 3, 3 extend longitudinally of base 1. In FIG. 1, the bed 2 supports thereon a cylinder unit 5 located remotely from die head 60 and having a rod 6 connected through a joint 7 to roll head 20. Roll head 20 is movable toward and away from die head 60 upon actuation of cylinder unit 5. Roll head 20 is provided with a stop 23 and bed 2 is provided with a stop 8, the stops 23 and 8 being engageable with each other to block the movement of roll head 20 toward die head 60 beyond a predetermined position. Either or both of the stops 23 and 8 are adjustable in position to change the predetermined stop position.

Roll head 20 includes a chamber 24 opening toward die head 60 and a vertical channel 25 located forwardly of chamber 24, vertical channel 25 being bounded by a pair of vertical walls 20*a*, 20*a* facing toward each other and including a pair of vertical grooves 26, 26, respectively. Chamber 24 accommodates therein a roll spindle casing 27 having a longitudinal through bore 28 in which there is disposed an idler roll spindle 30 rotatably supported in casing 27 by a set of roller bearings 29. The end of casing 27 that is remote from die head 60 is closed by an end cover 31.

A pressure roll 32 is coaxially mounted on spindle 30 at the end thereof facing toward die head 60, the roll 32 having a peripheral recess 33 of a cross-sectional shape corresponding to the cross-sectional contour of an annular product to be roll-formed. Spindle 30 includes a circular flange 34 adjacent pressure roll 32 and is retained within casing 27 by an annular retainer 35 secured to casing 27.

Figure 4:
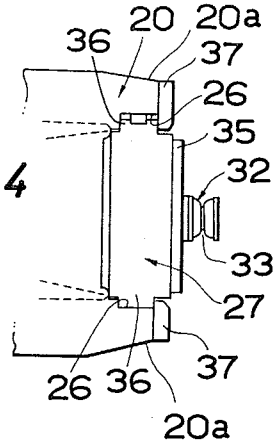
FIG. 4 is a fragmentary plan view as seen in the direction of the arrow IV of FIG. 1.
Figure 7:
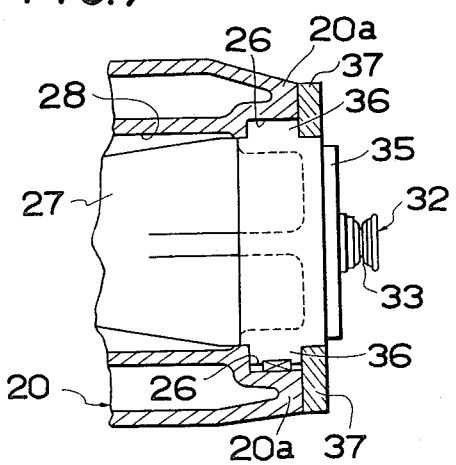
FIG. 7 is a fragmentary cross-sectional view taken along line VII—VII of FIG. 6.

As better shown in FIGS. 4 and 7, casing 27 includes a pair of vertical projections 36, 36 slidably fitted respectively in grooves 26, 26, the projections 36, 36 being trapped within grooves 26, 26 by a pair of holder plates 37, 37, respectively. Accordingly, grooves 26, 26 and holder plates 37, 37 jointly provide guides along which casing 27 is vertically movable to enable pressure roll 32 to be raised and lowered relative to roll head 20 and hence die head 60.

Die head 60 as shown in FIG. 1 is supported on a mount 61 disposed on base 1 and is provided with a cylindrical chamber 62 extending longitudinally of base 1. Accommodated within chamber 62 is a die spindle 63 in the form of a hollow cylinder rotatably supported within chamber 62 by means of a set of roller bearings 64.

Figure 3:
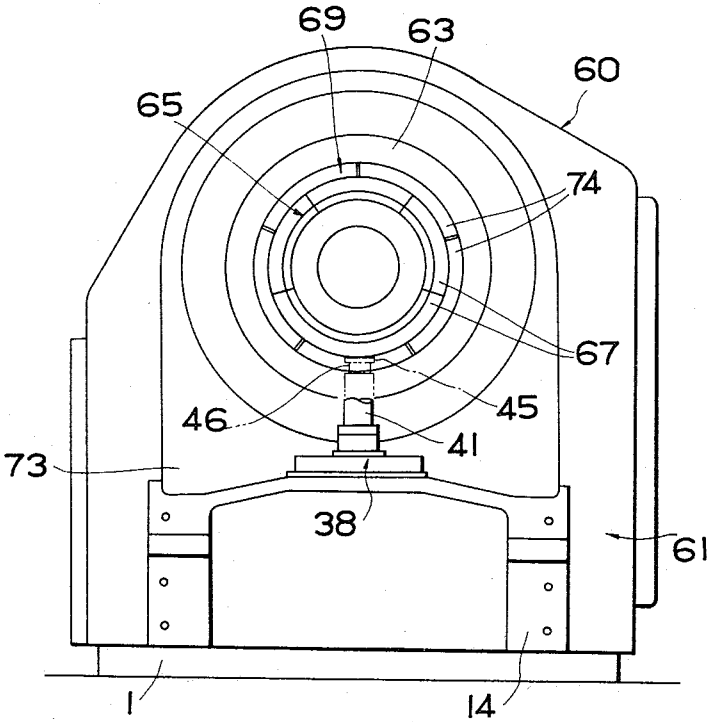
FIG. 3 is a front elevational view of a die head.
Figure 9:
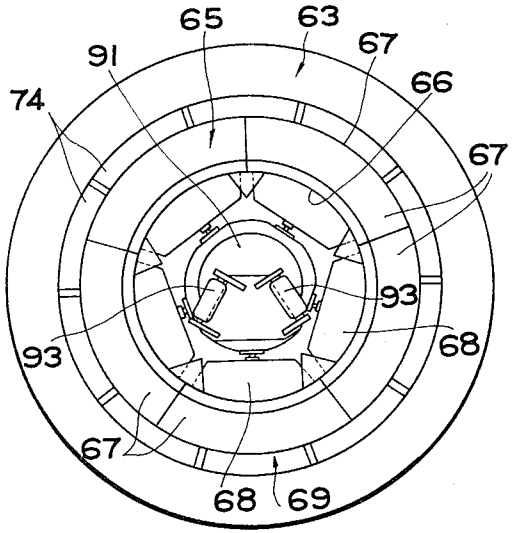
FIG. 9 is an enlarged front elevational view of a die spindle.

Die spindle 63 contains therein an annular die assembly 65 located at the end of spindle 63 which is directed toward roll head 20. The assembly 65 includes an annular shaper land 65 which projects radially inwardly and has a cross-sectional configuration identical to that of a product to be formed. The die assembly 65 includes a plurality of segmental die pieces 67 (FIGS. 3 and 9) and is held in an assembly comprising a plurality of segmental pieces 68 (FIG. 1) which corespond in number and position to die pieces 67. The die assembly 65 is fixedly maintained in die spindle 63 by means of a tapered ring 69 comprised of a plurality of segments each movable back and forth by a rod 70. The die spindle 63 is retained in die head 60 by an annular holder 63*a*.

Mount 61 includes a bracket 9 located remotely from bed 2 and which supports thereon an electric motor 10 which is operatively coupled with a speed reducer 11 by means of a belt 12, speed reducer 11 being disposed in a recess 61*a* in mount 61 and supported by a cover 71 of die head 60. The speed reducer 11 is provided with a pinion 13 on its output shaft, which drivingly meshes with a ring gear 72 fixed to and disposed around die spindle 63 at the end thereof remote from die assembly 65. When motor 10 is energized, die spindle 63 and hence die assembly 65 are rotated through belt 12, speed reducer 11, pinion 13, and ring gear 72.

Between bed 2 and mount 61 there is disposed a cylinder unit 38 supported by a bracket 14 fixed to bed 2, and by mount 61. The cylinder unit 38 includes a piston 40 from which vertically extends a piston rod 41 secured to roll spindle casing 27, so that casing 27 can be moved up and down when cylinder unit 38 is actuated, as will be described in greater detail hereinbelow.

Figure 14:
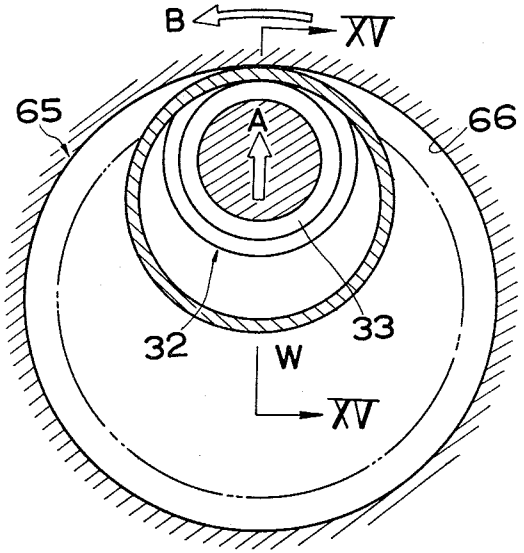
FIG. 14 is a schematic view showing the manner in which roll-forming operation is carried out by the apparatus of the present invention.
Figure 16:
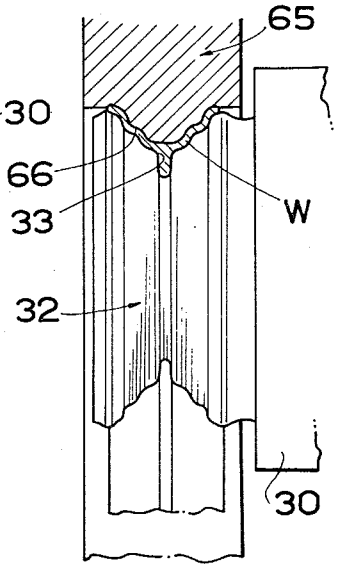
FIG. 16 is a view similar to FIG. 15, showing a finished annular product.
Figure 15:
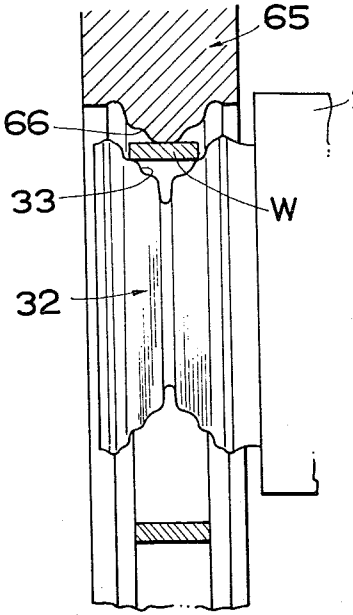
FIG. 15 is a cross-sectional view taken along line XV—XV of FIG. 14.

The following brief description of the operation of the apparatus will facilitate better understanding of the structure of the apparatus, which will be discussed more specifically hereinbelow. A blank ring W shown in FIG. 14 is supplied by cutting off a hollow cylinder of aluminum alloy which has been produced such as by molding, drawing or extruding processes, the blank ring W having a preselected width and a preselected diameter which is larger than that of pressure roll 32. The blank ring W is placed around the pressure roll 32, whereupon cylinder unit 5 (FIG. 1) is actuated to move roll head 20 forwardly toward die head 60, until movement of roll head 20 is stopped by stops 23 and 8. At this time, roll 32 is positioned substantially centrally in die assembly 65, with recess 33 of roll 32 being held in radial alignment with shaper land 66 of die assembly 65. The die assembly 65 is rotated in the direction of Arrow B (FIG. 14) by motor 10. Next, cylinder unit 38 is energized to raise roll spindle casing 27 vertically along grooves 26 in walls 20*a*, whereupon pressure roll 32 moves upwardly in the direction of Arrow A (FIG. 14) radially toward the inner periphery of die assembly 65. Upon engagement of the blank ring W with the revolving inner periphery of die assembly 65, the blank ring W and pressure roll 32 start to rotate, at which time the roll-forming of the blank ring W is initiated. Continued upward movement of pressure roll 32 from the position illustrated in FIG. 15 forces the blank ring W to be radially pressed against land 66 and, at the same time, to be expanded in diameter. The blank ring W is thus formed into an annular product $W_1$ between male land 66 and female recess 33 (FIG. 16). Because the product $W_1$ is confined to the inner periphery of die assembly 65, it will have an accurately dimensioned diameter and a high degree of circularity, free from distortions.

Figure 17:
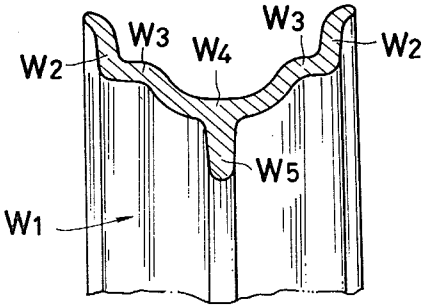
FIG. 17 is an enlarged cross-sectional view of a produced rim.
Figure 18:
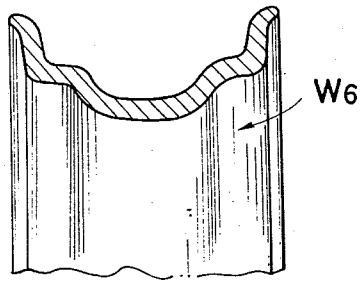
FIG. 18 is an enlarged cross-sectional view of a modified rim.

The annular product $W_1$ thus fabricated has no seams, and is particularly useful as rims for use in bicycle, motorcycle, or automobile wheels. The product or rim $W_1$ has a cross-sectional shape such as shown in FIG. 17, including a pair of flanges $W_2$,$W_2$, extending radially outwardly and spaced widthwise of the rim $W_1$ from each other, a pair of steps or shoulders $W_3$, $W_3$ adjacent to flanges $W_2$, $W_2$, respectively, a central web $W_4$ located between shoulders $W_3$, $W_3$, and a projection $W_5$ extending radially inwardly from central web $W_4$. Because the projection $W_5$ serves as a mounting base for spokes or spoke plates without the necessity of forming attachment holes in web $W_4$, the rim $W_1$ is especially advantageous for use as a rim for a tubeless wheel. The cross-sectional configuration of rim $W_1$ can be obtained by selecting a suitable set of die and roll members having a desired peripheral contour. One modified rim $W_6$ is illustrated in FIG. 18, in which there is no projection from the central web, such rim being formable on a proper choice of pressure roll.

The details of the central parts of the roll-forming apparatus will now be described.

Figure 2:
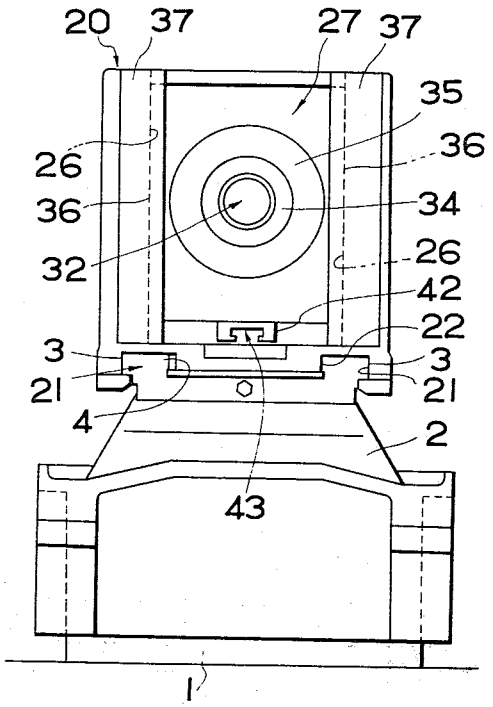
FIG. 2 is a front elevational view of a roll head.
Figure 8:
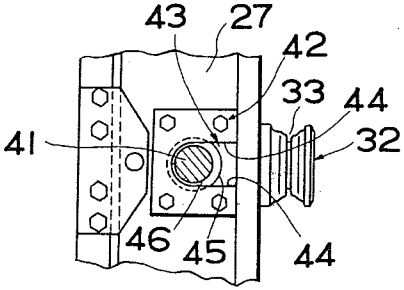
FIG. 8 is a fragmentary cross-sectional view taken along line VIII—VIII of FIG. 6.
Figure 6:
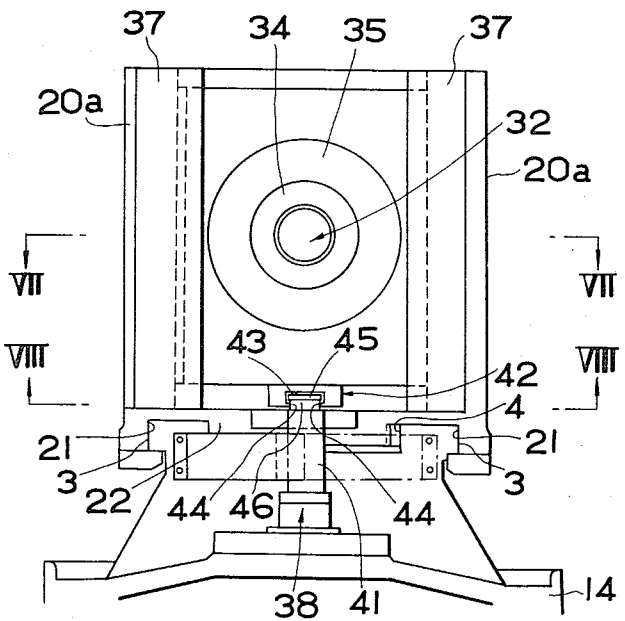
FIG. 6 is a front elevational view of the roll head, showing the connection between the roll spindle casing and the cylinder unit.

As best shown in FIGS. 2, 6 and 8, roll spindle casing 27 is provided at its lower side and near its forward end with a female coupling member 42 having a channel 43 opening downwardly and forwardly, and bounded partially by a pair of spaced lips 44, 44. The piston rod 41 of cylinder unit 38 is provided at its upper end with a male coupling member or head 45 slidably fitted in channel 43 and a neck 46 of a smaller diameter than that of head 45. The lips 44, 44 are disposed below head 45 at neck 46 to ensure coupling between casing 27 and cylinder unit 38.

Figure 5:
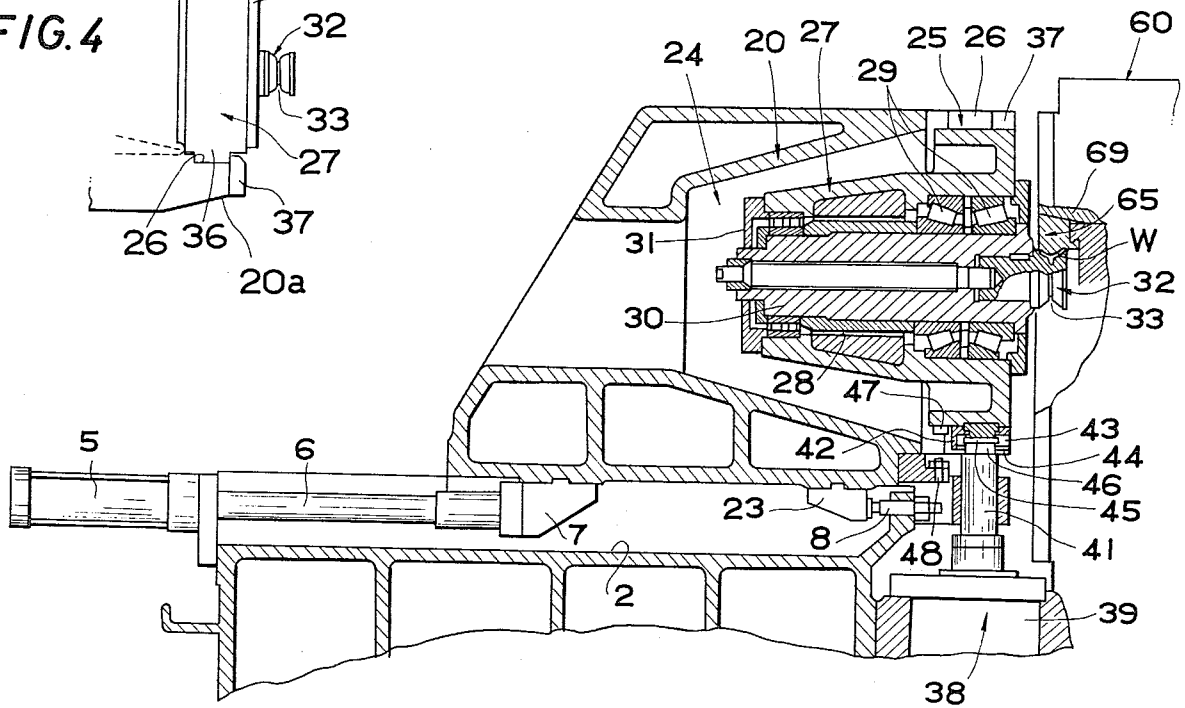
FIG. 5 is an enlarged cross-sectional view showing the manner in which a roll spindle casing and a cylinder unit are interconnected.

Before actuation of the apparatus, roll head 20 is retracted by cylinder unit 5 away from die head 60 and casing 27 is lowered with stops 47, 48 held against one another. At this time, piston rod 41 is withdrawn, bringing head 45 into horizontal alignment with channel 43 in female coupling member 42. Preparatory to operation of the apparatus, the cylinder unit 5 is energized to advance roll head 20 until stop 23 engages stop 8, whereupon channel 43 fits slidably over head 45 of piston rod 41, and pressure roll 32 is located in die assembly 65, as shown in FIG. 5. Next, cylinder unit 38 is activated to lift casing 27 for roll-forming operation. After a blank ring W has been roll-formed into a rim $W_1$, cylinder unit 38 is actuated again so as to lower casing 27 until it reaches its lower limit of movement upon engagement of stop 47 with stop 48. The cylinder unit 5 is then actuated to pull back roll head 20 away from die head 60, allowing female coupling member 42 to disengage head 45 of piston rod 41, whereupon casing 27 is held out of engagement with cylinder unit 38. With this arrangement, the cylinder unit 38 is in a fixed position and is engageable with casing 27 only when the latter is advanced toward die head 60 for roll-forming operation. Accordingly, cylinder unit 38 can be simplified in structure and reduced in size, and roll head casing 27 can be made as light in weight as possible.

Figure 10:
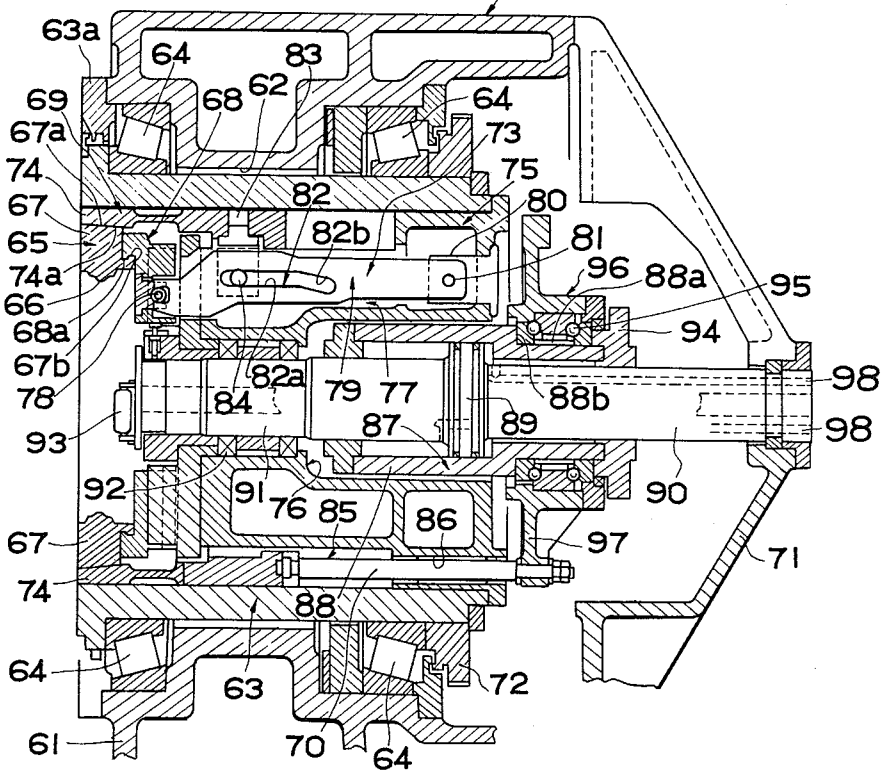
FIG. 10 is an enlarged cross-sectional view of the die head, illustrating the position of the parts with the die segments put together.

A die clamping and releasing mechanism 73 shown in FIG. 10 comprises a tapered ring 69 to be disposed between die spindle 63 and die assembly 65 which is put together. The die assembly 65 has a tapered outer periphery 67*a* flatly engageable with an inner periphery 74*a* of tapered ring 69. Tapered ring 69 comprises a plurality of segments 74 (FIG. 9) separable from each other. The mechanism 73 also includes a plurality of holders 68 for die segments 67, respectively, each holder 68 having a locking projection 68*a* directed radially inwardly and lockingly engageable with a radially outward locking projection 67*b* provided on one of the die segments 67. The die assembly 65 is thus maintained in its assembled position jointly by tapered rings 69 and by holders 68.

Within die spindle 63 there is disposed a cylindrical housing 75 which supports mechanism 73 and is rotatable with die spindle 63. The housing 75 has a coaxial bore 76 and a plurality of chambers 77 located radially outwardly of bore 76. Each of the chambers 77 accommodates therein an axial arm 79 pivotably connected at its one end by a pin 81 to a bracket 80 mounted on housing 75, the other end of the arm 79 supporting one of the holders 68 through a joint 78. Therefore, arm 79 is swingable or angularly movable about pin 81 in the radial direction of housing 75.

Each arm 79 includes a guide slot 82 extending longitudinally and located substantially centrally thereof. The guide slot 82 has a horizontal front portion 82*a* and a rear portion (82*b* inclined radially inwardly of housing 75. Each of the ring segments 74 has on its rear portion remote from the tapered surface 74*a* a bracket 83 projecting radially inwardly into one of the chambers 77 and having a pin 84 disposed in the guide slot 82 in one of the arms 79.

There is provided a plurality of spaces 85 between housing 75 and die spindle 63, the spaces 85 communicating axially with apertures 86 in housing 75. A rod 70 extends through one of the apertures 86 into one of the spaces 85 which is connected therewith, and is coupled at its one end with one of the segments 74 of tapered ring 69. The other end of rod 70 projects out of housing 75.

A cylinder unit 87 is disposed in the coaxial bore 76 in housing 75 for actuating the die clamping and releasing mechanism 73. Cylinder unit 87 includes a cylinder 88, a piston 89 slidable therein, a front piston rod 91 supported by bearings 92 on housing 75, and a rear piston rod 90 secured to cover 71 of die head 60. Mounted on the distal end of front piston rod 91 are guide rollers 93 for blank rings W. Because piston rods 90, 91 are fixed to cover 71, and axially to housing 75, respectively, cylinder 88 is movable over piston 89 when cylinder unit 87 is energized. Cylinder 88 is provided at the rear end portion thereof with a neck 88*a* having a shoulder 88*b*. Neck 88*a* is partially bounded by a plate member 94 secured to cylinder 88. Around neck 88*a* and between shoulder 88*b* and plate 94 there is rotatably disposed a power transmission member 96 mounted by bearings 95 on cylinder 88. The power transmission member 96 includes an annular flange 97 to which rods 70 are connected. Passages 98 are disposed in piston rod 90 and piston 89 and open to the interior of cylinder 88. The passages 98 are held in fluid communication with a suitable source of oil so as to supply oil to and discharge it from cylinder 88 for energization of cylinder unit 87. With the die clamping and releasing mechanism 73 and cylinder unit 87 thus arranged, die head 60 is relatively compact in size. During operation of the apparatus, die spindle 63 and housing 75 contained therein are rotatable around cylinder unit 87 which is held stationarily with respect to cover 71 via rear piston rod 90.

Figure 11:
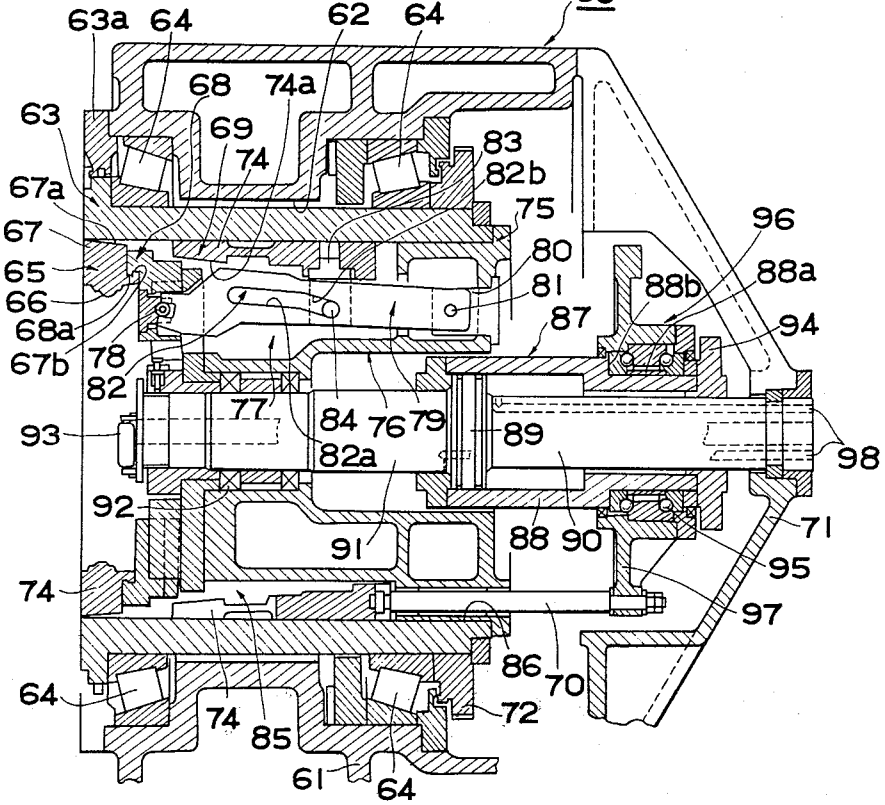
FIG. 11 is a view similar to FIG. 10, showing the position of the parts with the die segments spread apart.

FIG. 10 illustrates the position of the parts in which die segments 67 are put together and clamped in position, and FIG. 11 shows the position of the parts wherein die segments 67 are separated from each other for releasing a finished product out of die assembly 65. The die assembly 65 is disassembled as follows. While die spindle 63 is being rotated, passage 98 is hydraulically pressurized so as to supply pressurized oil into the rear rod side of cylinder 88, whereupon cylinder 88 is moved a preselected stroke from the position of FIG. 10 to the position of FIG. 11. Such movement of cylinder 88 causes flange 97 to retract rods 70 secured thereto, thereby withdrawing tapered ring segments 74 a corresponding distance away from die assembly 65. As the tapered ring segments 74 are retracted out of engagement with die segments 67, with pin 84 secured to bracket 83 being moved in the horizontal portion 82*a* of slot 82, the die segments 67 are still in the assembled stage and are kept radially away from die spindle 63 (FIG. 10). Continued retraction of tapered ring segments 74 causes pin 84 to enter the inclined portion 82*a* of slot 82, whereupon arms 79 start moving pivotably about pins 81, thereby enabling holders 68 to spread radially outwardly. Accordingly, die segments 67 connected respectively to holders 68 through locking projections 68*a*, 67*b* are moved radially outwardly toward die spindle 63 as they are spread and separated away from each other (FIG. 11). A finished product that has been roll-formed can then be removed from die assembly 65 by means of a suitable remover (not shown).

After a roll-formed product has been removed, die segments 67 are put together again by actuation of cylinder unit 87, and at the same time roll head 20 is advanced again with a subsequent blank ring placed around pressure roll 32 for a subsequent cycle of roll-forming operation. The die segments can be released and combined together while die spindle 63, mechanism 73 and die segments 67 themselves are being rotated. Accordingly, the motor 10 can be continuously operated for cycles of operation without down time, and the apparatus can manufacture desired products at a very high rate of production.

Figure 12:
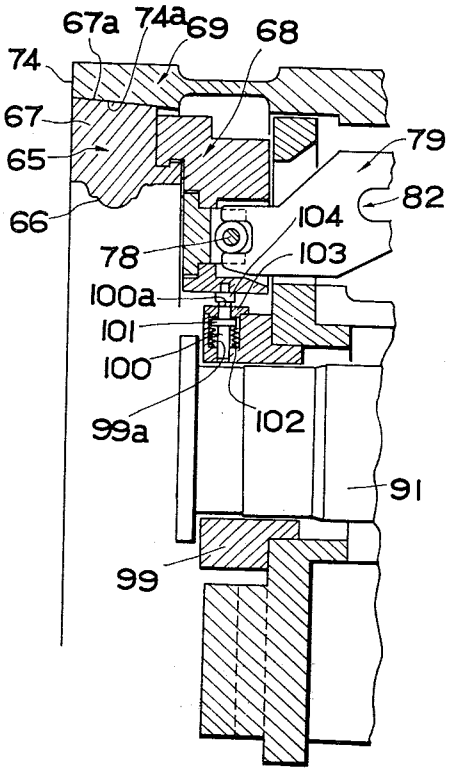
FIG. 12 is a fragmentary enlarged cross-sectional view of a die clamping and releasing mechanism.
Figure 13:
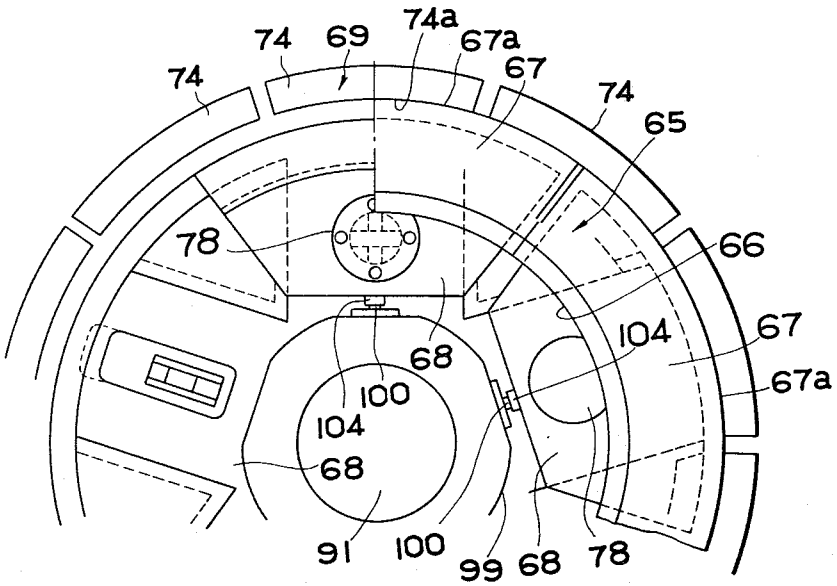
FIG. 13 is a fragmentary enlarged front elevational view of the mechanism of FIG. 12.

As illustrated in FIGS. 12 and 13, a ring 99 is rotatably disposed around the distal end of front rod 91 and is secured to housing 75 for co-rotation therewith. Ring 99 is provided with a plurality of cavities 99*a* angularly spaced from each other and corresponding in number and position to holders 68. Each cavity 99*a* opens radially outwardly and accommodates therein a pusher 100 movable radially of ring 99. Compression springs 102 are placed between a flange 101 mounted on pusher 100 and the bottom of cavity 99*a* so as to normally urge pusher 100 radially outwardly. The cavity 99*a* is closed off by a cover 103 by which pusher flange 101 is retained in cavity 99*a*. The pusher 100 has an end 100*a* projecting through cover 103 and engageable with an abutment 104 mounted centrally on each holder 68 at its radially inward portion. When die segments 67 are combined together, holders 68 are biased radially outwardly by spring-loaded pushers 100.

When die segments 67 are to be put together from the disassembled position shown in FIG. 11, cylinder unit 87 is actuated to move tapered ring segments 74 forwardly toward die segments 67, whereupon pins 84 are advanced out of the inclined portions 82*b* into the horizontal portions 82*a* of slots 82, causing arms 79 to pivot radially inwardly of housing 75. At the same time, holders 68 and die segments 67 are also moved radially inwardly. When tapered ring segments 74 are about to engage die segments 67, the abutments 104 on holders 68 abut against the ends of the spring-biased pushers 100, and the holders 68 are angularly displaced about joints 78 under the force from pushers 100. Accordingly, die segments 67 are not completely combined before engagement of tapered ring segments 74 with die segments 67. As the tapered ring segments 74 progress further, their tapered surfaces 74*a* start engaging the tapered surfaces 67*a* of die segments 67, which then are pushed against the bias of springs 102 radially inwardly into an assembled position in which die segments 67 are arranged in a high degree of circularity. With this arrangement, each of the die segments 67 is prevented from getting misaligned with adjacent segments since they are forcibly guided by tapered ring segments 74 which are advanced in a synchronized manner. The die assembly 65 thus assembled can produce annular rims with an increased degree of precision and which are free from distortions.

It should be understood that various changes and modifications in the structure and function of the present invention may be made without departing from the scope of the appended claims.

We claim:

1. An apparatus for roll-forming a blank ring into an annular product, comprising:

a substantially elongated base;

a die head having an annular die rotatably supported therein;

said die head being fixedly mounted on said base;

said annular die being directly driven to rotate by driving means;

a roll head having a pressure roll rotatably supported therein and movable toward and away from said annular die;

said roll head being mounted on said base;

said pressure roll being movable from a position away from said annular die, at which a blank ring may be positioned around said pressure roll, to a position within said annular die;

said annular die including an inner surface which corresponds substantially to an outer peripheral surface of an annular product to be roll-formed;

said pressure roll including an outer surface which corresponds substantially to an inner peripheral surface of said product to be roll-formed;

means for moving said pressure roll radially of said annular die when said pressure roll is positioned in said annular die, whereby said blank ring can be interposed between said pressure roll and said annular die, with said blank ring positioned around said pressure roll so as to be engaged with said inner surface of said annular die at a predetermined position with respect to said annular die; and said means being disposed on said base in a position substantially between said die head and said roll head, separately from said roll head.

2. An apparatus for roll-forming a blank ring into an annular product, comprising:

a substantially elongated base;

a die head having an annular die rotatably supported therein;

a roll head having a pressure roll rotatably supported therein and movable toward and away from said annular die;

said die head and said roll head being mounted on said base;

said annular die including an inner surface which corresponds substantially to an outer peripheral surface of an annular product to be roll-formed;

said pressure roll including an outer surface which corresponds substantially to an inner peripheral surface of said product to be roll-formed;

means for moving said pressure roll radially of said annular die when said pressure roll is positioned in said annular die, whereby a blank ring can be interposed between said pressure roll and said annular die, with said blank ring positioned around said pressure roll so as to be engaged with said inner surface of said annular die at a predetermined position with respect to said annular die;

said means being disposed on said base in a position substantially between said die head and said roll head, separately from said roll head;

a bed disposed on said base, said roll head being slidably mounted on said bed;

said roll head further including a casing, said casing being vertically movable within said roll head;

a spindle, said spindle being rotatably mounted on said casing and supporting said pressure roll thereon for rotation therewith;

a cylinder unit disposed outside of said casing; and said cylinder unit being provided with a piston rod engageable with said casing only when said pressure roll is positioned in said annular die.

3. An apparatus for roll-forming a blank ring into an annular product, comprising:

a substantially elongated base;

a die head having an annular die rotatably supported therein;

a roll head having a pressure roll rotatably supported therein and movable toward and away from said annular die;

said die head and said roll head being mounted on said base;

said annular die including an inner surface which corresponds substantially to an outer peripheral surface of an annular product to be roll-formed;

said pressure roll including an outer surface which corresponds substantially to an inner peripheral surface of said product to be roll-formed;

means for moving said pressure roll radially of said annular die when said pressure roll is positioned in said annular die, whereby a blank ring can be interposed between said pressure roll and said annular die, with said blank ring positioned around said pressure roll so as to be engaged with said inner surface of said annular die at a predetermined position with respect to said annular die;

said means being disposed on said base in a position substantially between said die head and said roll head, separately from said roll head;

said die head further including a die spindle in the form of a hollow cylinder rotatably mounted on said die head, said annular die being mounted in said die spindle; and said annular die comprising:

a plurality of separable die segments;

means for clamping and releasing said die segments;

a housing mounted in said die spindle and having disposed therein said clamping and releasing means;

a cylinder unit for actuating said clamping and releasing means, said cylinder unit being fixedly mounted on said die head; and said cylinder unit having a portion thereof disposed in said die spindle.

4. An apparatus for roll-forming a blank ring into an annular product, comprising:

a die head having an annular die rotatably supported therein;

a roll head having a pressure roll rotatably supported therein and movable toward and away from said annular die;

means for moving said pressure roll radially of said annular die when said pressure roll is positioned in said annular die, whereby a blank-ring can be interposed between said pressure roll and said annular die;

said die head further including a die spindle in the form of a hollow cylinder rotatably mounted on said die head, said annular die being mounted in said die spindle;

a plurality of separable die segments;

means for clamping and releasing said die segments;

a housing mounted in said die spindle and having disposed therein said clamping and releasing means;

a cylinder unit for actuating said clamping and releasing means, said cylinder unit being fixedly mounted on said die head; and wherein said clamping and releasing means comprises:

a tapered ring adapted to be interposed between said die segments and said die spindle so as to clamp said die segments; and a plurality of holders holding said die segments, said holders being movable so as to release said die segments in response to movement of said tapered ring away from said die segments.

5. An apparatus according to claim 4, wherein said clamping and releasing means further comprises:

a plurality of arms pivotally mounted on said housing and operatively connected to said tapered ring;

said holders being supported on said arms; and said arms being pivotable when said tapered ring is moved toward and away from said die segments.

6. An apparatus for roll-forming a blank ring into an annular product, comprising:

a die head having an annular die rotatably supported therein;

a roll head having a pressure roll rotatably supported therein and movable toward and away from said annular die;

means for moving said pressure roll radially of said annular die when said pressure roll is positioned in said annular die, whereby a blank ring can be interposed between said pressure roll and said annular die;

said die head further including a die spindle in the form of a hollow cylinder rotatably mounted on said die head, said annular die being mounted in said die spindle;

a plurality of separable die segments;

means for clamping and releasing said die segments;

a housing mounted in said die spindle and having disposed therein said clamping and releasing means;

a cylinder unit for actuating said clamping and releasing means, said cylinder unit being fixedly mounted on said die head;

said cylinder unit including a piston and a piston rod;

said die head including a cover supporting said piston rod;

said cylinder unit further including a cylinder slidable over said piston into and out of said die spindle; and said clamping and releasing means being actuated in response to movement of said cylinder.

7. An apparatus for roll-forming a blank ring into an annular product, comprising:

a die head having an annular die rotatably supported therein;

a roll head having a pressure roll rotatably supported therein and movable toward and away from said annular die;

means for moving said pressure roll radially of said annular die when said pressure roll is positioned in said annular die, whereby a blank ring can be interposed between said pressure roll and said annular die;

said die head further including a die spindle in the form of a hollow cylinder rotatably mounted on said die head, said annular die being mounted in said die spindle;

a plurality of separable die segments;

means for clamping and releasing said die segments;

a housing mounted in said die spindle and having disposed therein said clamping and releasing means;

a cylinder unit for actuating said clamping and releasing means, said cylinder unit being fixedly mounted on said die head; and spring means for releasing said die segments, whereby said clamping and releasing means clamps said die segments into an assembled position against the force from said spring means.

8. An apparatus according to claim 6, wherein:

said cylinder unit has a portion thereof disposed in said die spindle.

9. An apparatus according to claim 7, wherein said clamping and releasing means comprises:

a tapered ring adapted to be interposed between said die segments and said die spindle so as to clamp said die segments; and a plurality of holders holding said die segments, said holders being movable so as to release said die segments in response to movement of said tapered ring away from said die segments.

10. An apparatus according to claim 3, wherein said clamping and releasing means comprises:

a tapered ring adapted to be interposed between said die segments and said die spindle so as to clamp said die segments; and a plurality of holders holding said die segments, said holders being movable so as to release said die segments in response to movement of said tapered ring away from said die segments.

11. An apparatus according to claim 10, wherein said clamping and releasing means further comprises:

a plurality of arms pivotally mounted on said housing and operatively connected to said tapered ring;

said holders being supported on said arms; and said arms being pivotable when said tapered ring is moved toward and away from said die segments.

12. An apparatus according to claim 3, wherein:

said cylinder unit includes a piston and a piston rod;

said die head includes a cover supporting said piston rod;

said cylinder unit further includes a cylinder slidable over said piston into and out of said die spindle; and said clamping and releasing means is actuated in response to movement of said cylinder.

13. An apparatus according to claim 3, further including:

spring means for releasing said die segments, whereby said clamping and releasing means clamps said die segments into an assembled position against the force from said spring means.

* * * * *